United States Patent [19]

Scott et al.

[11] Patent Number: 4,827,821

[45] Date of Patent: May 9, 1989

[54] CUTTING CHAIN

[75] Inventors: Lewis A. Scott, Lake Oswego; Johann Weber, Estacada, both of Oreg.

[73] Assignee: Omark Industries, Inc., Portland, Oreg.

[21] Appl. No.: 928,835

[22] Filed: Nov. 10, 1986

[51] Int. Cl.[4] ..... B27B 33/14

[52] U.S. Cl. ..... 83/831; 83/833

[58] Field of Search ..... 30/381; 83/651.1, 830, 83/831, 832, 833, 834, 788; 59/5, 78, 83, 84; 414/306

[56] References Cited

U.S. PATENT DOCUMENTS

| | | | |
|---|---|---|---|
| 2,356,437 | 8/1944 | Smith | 30/381 |
| 3,170,497 | 2/1965 | Ehlen et al. | 143/135 |
| 3,516,459 | 6/1970 | Silvon et al. | 30/381 X |
| 4,034,556 | 7/1977 | Riber | 59/78 |
| 4,157,673 | 6/1979 | Bruno | 83/837 |

FOREIGN PATENT DOCUMENTS

| | | | |
|---|---|---|---|
| 0028418 | 5/1981 | European Pat. Off. . | |
| 814660 | 9/1951 | Fed. Rep. of Germany | 83/830 |
| 1578812 | 7/1969 | France | 414/306 |
| 2368343 | 5/1978 | France . | |
| 77127 | 5/1982 | Japan | 414/306 |
| 322040 | 9/1962 | Sweden . | |
| 2009670 | 6/1979 | United Kingdom . | |
| 2097718 | 10/1982 | United Kingdom . | |
| 2173735A | 10/1986 | United Kingdom . | |

*Primary Examiner*—Frank T. Yost
*Assistant Examiner*—Michael D. Folkerts
*Attorney, Agent, or Firm*—Klarquist, Sparkman, Campbell, Leigh & Whinston

[57] ABSTRACT

A lightweight disposable cutting chain for use with small, compact power supplies comprises in one embodiment a series of links formed of wire. On certain links an end of the wire loop forming the link is cut to form a sharp edge capable of shaving material, such as wood, being cut. The links are arranged so that a narrow kerf is first cut by the links, other links being formed with cutting edges to shave material and widen the kerf. In other embodiments some or all of the links comprise metal plates formed by stamping from sheet metal.

19 Claims, 2 Drawing Sheets

FIG. 1
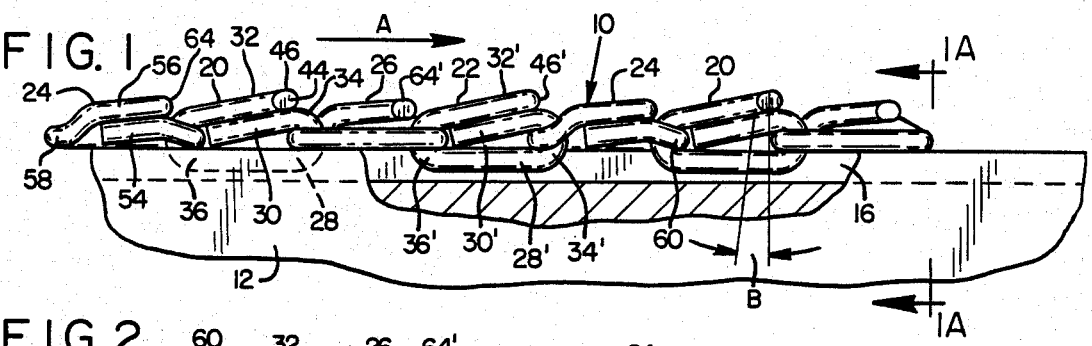
FIG. 2
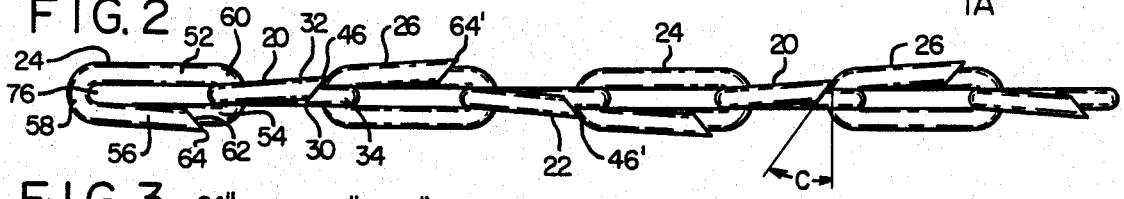
FIG. 3
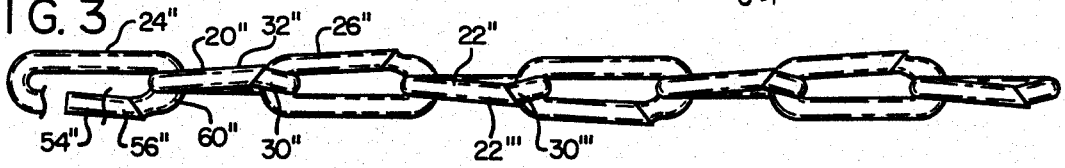
FIG. 4
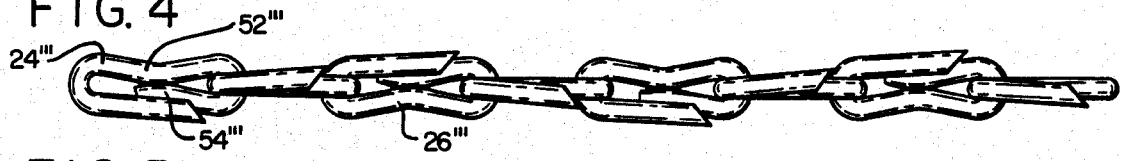
FIG. 5
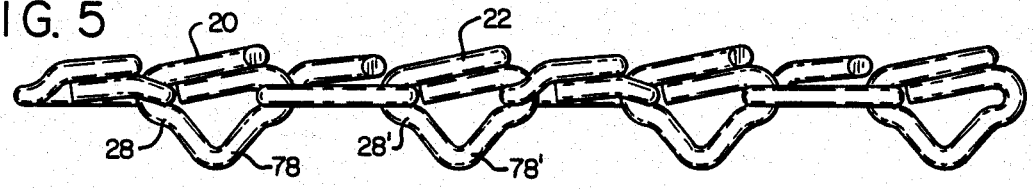
FIG. 1A
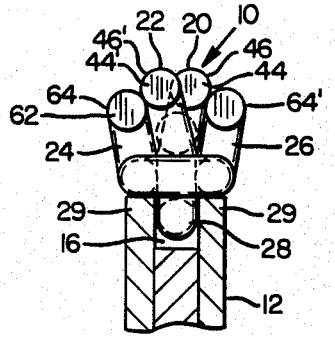
FIG. 7A
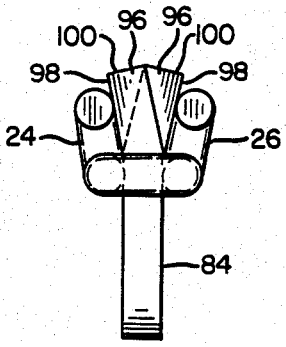
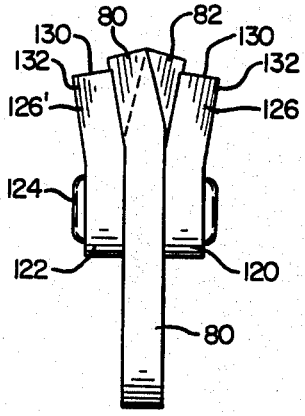
FIG. 10A
FIG. 11
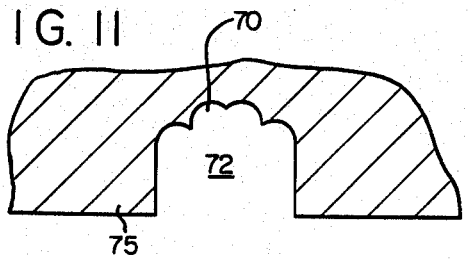

CUTTING CHAIN

The present invention relates generally to cutting chains, and more particularly to a cutting chain that can be used with small, compact power supplies for cutting wood and other materials.

Cutting chain technology in its early stages was dominated by the basic requirements of the professional logger who primarily used large, powerful chain saws. Major changes in the saw chain industry over the years have resulted in the down-sizing of two-cycle gasoline engines from large 50 pound power packages to 5 pound power packages. This has expanded the use of chain saws into the consumer or nonprofessional user market, as well as the professional pruning, clearing and firewood markets.

Small lightweight chain saws using conventional saw chains are now used for heavy orchard pruning and other similar commercial and small home oriented jobs. Pruning or clearing of two inch diameter limbs or smaller is generally performed with a variety of hand tools. The use of hand tools, rather than the available power tools, is dictated by the lightweight maneuverability, control and safety of the hand tools as compared to that of the available lightweight chain saws.

Power packages even smaller than the five pound two-cycle engines are now available. However, there is no cutting chain available which can match their limited size and output.

BRIEF DESCRIPTION OF THE INVENTION

Accordingly, it is an object of the present invention to provide a cutting chain having low power consumption characteristics.

Another object of the present invention is to provide such a chain which is simple and inexpensive to manufacture.

Still another object of the present invention is to provide a chain which is replaced rather than sharpened when dull.

A further object of the present invention is to provide a cutting chain which is compatible in size with small hand held power units and is safe and easy to use.

Still another object is to provide a cutting chain which will form a smooth surface on the material being cut.

In accordance with the preferred embodiment of the invention, a cutting chain for use with a low horsepower, lightweight motor is constructed of interconnected links formed by wire loops. One end of each loop is shaped to define a cutting edge to shave away material in the object, such as a tree limb, being cut. The links are arranged so that certain of the links cut a narrow channel kerf in the object, while others follow to widen the kerf and provide clearance for the chain and supporting guide bar.

BRIEF DESCRIPTION OF THE DRAWINGS

FIG. 1 is a side elevation of a short length of a cutting chain constructed in accordance with one embodiment of the invention, showing the chain positioned on a guide bar.

FIG. 1A is an enlarged view, looking in the direction of the arrows 1A in FIG. 1.

FIG. 2 is a slightly enlarged top view of the cutting chain of FIG. 1, the guide bar being omitted.

FIG. 3 is a slightly enlarged top view of a modification of the FIG. 1 embodiment.

FIG. 4 is a top view of another embodiment of a cutting chain of the invention.

FIG. 5 is a side view of yet another embodiment of a cutting chain of the invention.

FIG. 7A is an enlarged end view taken along line 7A of FIG. 7.

FIG. 10A is an enlarged end view, partly in section, taken along line 10A of FIG. 10.

FIG. 11 is an enlarged fragmentary cross sectional view showing the configuration of a kerf cut in wood by a cutting chain constructed in accordance with the invention.

DETAILED DESCRIPTION OF PREFERRED EMBODIMENTS

Figure 6:
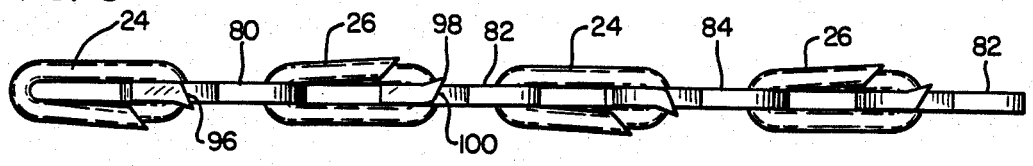
FIG. 6 is a top view of a further embodiment of a cutting chain of the invention.

The cutting chain of the present invention is formed of a multiplicity of links interconnected to form an endless loop adapted to be mounted to a guide bar on a small hand held power unit. To facilitate an understanding of the cutting chain of the invention and the relationship of the elements thereof to each other the orientation of such elements will be related as they occur in a length of chain positioned on a guide bar as shown in FIG. 1. It will be appreciated that the orientation of the elements of a chain will continually change as the chain moves in the generally elliptical path defined by the guide bar.

Referring now to the drawings each of the embodiments of the cutting chain of the invention is comprised of vertically oriented links alternatingly interconnected with horizontally oriented links. The vertically oriented links have an upper portion with an upwardly oriented cutter element and a lower portion configured to be received by a groove in the guide bar for guiding the saw chain around the guide bar. The horizontally oriented links each has a cutter element oriented sidewardly of the upwardly oriented cutter elements of the vertical links. The cutter elements of the horizontally oriented links are provided with cutter elements effective to remove material to the side of the chain and in the vertical direction as well. The upwardly vertically oriented cutter elements of the vertical links project upwardly from the base of the chain a greater distance than the sidewardly oriented cutter elements project upwardly from the base of the chain.

In the embodiments depicted in FIGS. 1–5, each of the vertically and horizontally oriented links is comprised of a piece of wire bent to form an enclosed, elongated loop shape. In the embodiments depicted in FIGS. 6–8, each of the horizontally oriented links is comprised of a piece of wire bent to form an enclosed, substantially loop shape, while each of the vertical oriented links is comprised of a flat plate-like member. In the embodiments depicted in FIGS. 9–10A, all links are comprised of flat plate-like members interconnected to each other and the central members by bearing pins.

Referring more particularly to FIGS. 1, 1A, and 2, the simplest all-wire version of the inventive cutting chain is represented generally by the numeral 10 and is adapted to travel in direction "A" around a guide bar 12 formed with a groove 16 for receiving a portion of chain 10 as more fully described below.

Chain 10 comprises upright or vertical links 20, 22, of left and right configuration, respectively, which alternate in the chain, and horizontal links 24, 26, of right and left configuration, respectively, which also alternate in the chain. The horizontal links 24, 26 are connected to and alternate with the vertical links 20, 22 to form an endless loop for mounting around the guie bar 12. The vertical links 20, 22 include lower central portions 28, 28', respectively, which slidably fit within the peripheral groove 16 in the guide bar 12. The lower surfaces of the horizontal links slidably rest on the side rails 29 which define the groove 16 of the guide bar.

The lower portion of a vertical link 20 comprises the central part 28 of the wire loop defining the link and to which opposite end portions 30, 32 are connected by a forward bight portion 34 and a rearward bight portion 36, respectively. The central portion 28 is substantially straight with its axis extending substantially parallel to the path of travel of the link and, as indicated above, is adapted to slide within the groove 16 of the saw bar 12. As best seen in FIG. 2, the axis of the end portion 30 is parallel to the path of travel of the chain, but, as shown in FIG. 1, the end portion 30 slopes downwardly from the forward bight 34 and terminates adjacent the trailing horizontal link 24. The end portion 32, on the other hand, slopes upwardly from the rearward bight 36 parallel to the end portion 30 when viewed from the side as in FIG. 1, but angularly outwardly to the left of the central plane of the chain at a small acute angle, preferably between two and five degrees, when viewed from above as in FIG. 2, so that the upper end of the end portion 32 is offset slightly to the left side of link. The end face 44 is cut at an angle with respect to the axis of the wire so that the upper and outermost quadrant edge portion 46, see FIG. 1A, defines a cutting edge to remove material in the workpiece being cut. The offset of the end portion 32 is preferably such that the cutting edge 46 has a clearance of between 0.007 and 0.008 inch with respect to the sides of the end portion 30, but which clearance may range from 0.006 to 0.015 inch. If the cutting chain is to be used with hardwoods the face 44 in a vertical plane parallel to the guide is inclined rearwardly from the uppermost part of the edge 46 and at an included angle B in FIG. 1 of between about three to six degrees, preferably about five degrees/ In soft woods, angle B is between ten to twenty degrees, preferably about fifteen degrees. The slope of face 44 is also such that it is inclined rearwardly at an angle C of between about twenty to thirty-five degrees, preferably about thirty degrees in a horizontal plane.

The loop of a vertical link 22 as seen in FIG. 1 is similarly formed and includes a central portion 28' and end portions 30', 32' joined to the central portion by bights 34', 36' respectively. The end portion 32', however, is inclined angularly outwardly from the path of travel to the right with the end surface 44', see FIG. 2, cut at an angle to form a cutting edge 46', see FIG. 1A, on the right side of the links.

The horizontal links 24 are each formed with a central portion 52 and opposite end portions 54, 56 joined to the central portion by bight portions 58, 60, respectively. The rearward bight portion 58 extends through the loop of the forward bight 34 of the trailing vertical link 22. The forward bight 60 extends through the loop of the rearward bight 36 of the preceeding vertical link 20. The bight portions of the links thus interconnect the links.

As best seen in FIG. 2, the central portion 52 of link 24 is substantially straight with its axis extending substantially parallel to the path of travel and is positioned on the left side of the chain. The end portion 54 extends rearwardly from the bight portion 60. As viewed from above in FIG. 2 the end portion 54 is parallel to the central portion 52, but as viewed from the side as in FIG. 1 the end portion 54 is arched the purpose for which will be explained shortly. The end portion 56 as viewed from the side (see FIG. 1) is bent rather abruptly upwardly from the rearward bight 58 and thence extends forwardly parallel to and over the downwardly descending end part of the arched end portion 54 which supports the end portion 56. As viewed from the top, see FIG. 2, the end portion 56 is inclined to the right by a small angle, preferably between two and five degrees so as to provide an offset of the outer cutting edge to be described of between 0.006 to 0.015 inch, preferably 0.007 to 0.008 inch. The end face 62 is cut at an angle to the axis of the wire so as to form a cutting edge 64, see FIG. 1A, on the outermost side portion of the end surface. The slope of the face 62 is preferably the same as that of the face 44.

The horizontal links 26 are mirror images of the links 24 being formed so as to provide cutting edges 64', see FIG. 1A, that are positioned on the left side of the chain.

The overlapping portions of each link are welded to each other to enhance the rigidity of the links. With reference to FIG. 1A and 11, in operation the vertical links 20, 22 serve as central cutting links that remove material from the center groove like portion 70 of a kerf 72 being cut in a work piece 75 while the horizontal links 24, 26 remove material from side portions of the kerf to provide clearance for the chain 10 and guide bar 12.

The alternate angling of the vertical links 20, 22 provides a chip clearing function for clearing the chips from the kerf which are cut by the cutter elements thereof. Alternatively, each of the cutter elements of the vertical links 20, 22 could be precisely vertical over the central portions of the links. Also, the angling from vertical need not alternate from link to link around the endless loop. Best performance is expected when the vertical links are configured as shown to provide a slightly wider central cut over that were each cutter precisely vertical, and to clear the chips from the kerf.

The loop of each of the horizontally oriented links 24, 26 defines a central aperture 76 as shown in FIG. 2 adapted to receive the teeth of an idler sprocket and the drive sprocket (not shown) of a power unit.

The chain is preferably formed of 1020 steel wire of 0.030 inch diameter. After forming and assembly of the chain, the wire is preferably carburized and heat treated.

As shown in FIG. 1A, the sidewardly directed cutter element edges 64, 64' of the horizontal links 24, 26 do not extend upwardly from the base of the chain as great a distance as do the cutting edges 46, 46' of the vertical links 20, 22. This concept is opposite to that of conventional scratcher type saw chains or crosscut circular saw tooth configurations. In the latter type the side cutting or slitting elements project higher than the central elements for the purpose of severing material along the edges of the kerf, while the central cutting elements act as rakers positioned to split the severed chip away from the bottom of the kerf between the cuts made by the side cutting or slitting elements.

However, the inventive construction with the center cutting vertical links 20, 22 extending higher than the sidewardly directed cutting elements of the horizontal links has advantages. As noted previously, vertical links 20, 22 cut out a center portion 70 of the kerf while the horizontal links 24, 26 pull chips out of the side walls of the center portion of the kerf cut by the vertical links. The formation of an initial center groove 70 stabilizes the chain so that it holds its position and skate on the work being cut is minimized. This stabilitation enables the chain to form a smooth surface on the work which, of course, is especially desirably in tree pruning.

As illustrated, each of the horizontal and vertical links in the loop includes a cutter element. As will be appreciated by those skilled in the art, every link need not have a cutter as long as chain speed could be maintained to perform the necessary cutting operation.

Also, as will be appreciated by those skilled in the art, the sequence of the cutting elements (alternating left and right from the respective vertical and horizontal links) is not critical. The cutters could be randomly sequenced around the endless loop.

A modified version of the chain of FIG. 1 is shown in FIG. 3. In this modification the end portion 54'' of the loop of horizontal link 24'', in addition to being arched vertically is offset horizontally outwardly from the bight 60'' and thence extends rearwardly vertically beneath and parallel to the overlying opposite end portion 56'' to support the latter more fully. The horizontal links 26'' are similarly formed. Likewise, the vertical links 20'', 22'' may be offset laterally from the forward bight thereof and the end portions 30'', 30''', respectively, extend rearwardly beneath the overlying end portions 32'', 32''' parallel thereto so as to support the cutters.

The chain ean also be constructed in a way to positively prevent crosslinking or tangling of the links. As illustrated in FIG. 4, end portion 54''' of a horizontal link 24''' and the center portion 52''' thereof can be bent into contact with each other and welded together. The horizontal links 26''' can be similarly formed. This construction prevents the links from sliding in the loops of the links and thereby becoming tangled.

As illustrated in FIG. 5, the center portions 28, 28' of the vertically oriented links 20''', 22''' may be formed with a downwardly projecting tang 78, 78', respectively, for a more positive engagement with the guide bar groove 16. The tangs 78, 78' obviously could take a variety of shapes.

Figure 7:
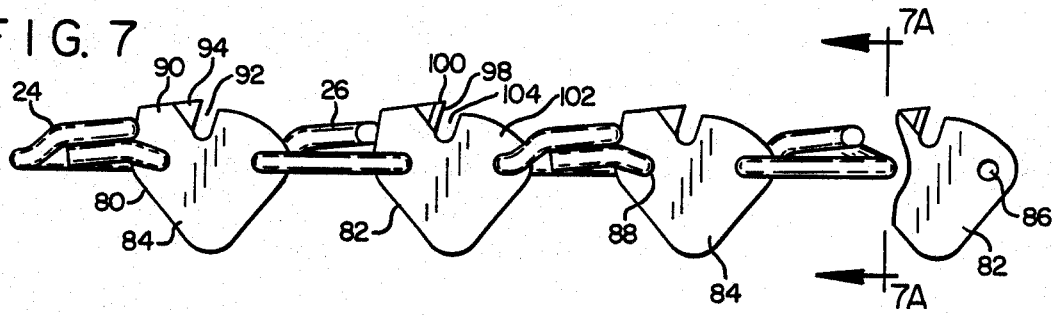
FIG. 7 is a side view of the modification of FIG. 6.

Referring more particularly to FIGS. 6 and 7, vertically oriented links 80, 82 can be formed of flat plate-like stock which alternate with horizontally oriented links 24, 26 made of wire. The links 80, 82 are formed with a lower tang 84 adapted to slide in the groove 16 of a guide bar. Each link 80, 82 is formed with a forward opening 86 for receiving the bight of the forward horizontal link and a rearward opening 88 for receiving the bight of the rearward horizontal link. Projecting upwardly on each link 80, 82 is a cutter forming portion 90 including a slot 92 extending downwardly from the upper edge thereof at a slight rearward inclination. The topmost part 94 of the plate is bent outwardly, those of the links 80 to the right, those of the links 82 to the left. The forward face 96 of the bent out part 94 is shaped so that the outer and top edge define cutting edges 98, 100 in FIG. 6, respectively. Such cutting edges may be formed during the stamping of the link from steel sheet stock, the edge being formed in the die. The forward portion 102 of the top portion of the link has a peak 104 elevation of between 0.005 and 0.030 inch beneath the top cutting edge 100 to provide clearance for such edge and slopes downwardly from such peak to the front of the link.

Figure 8:
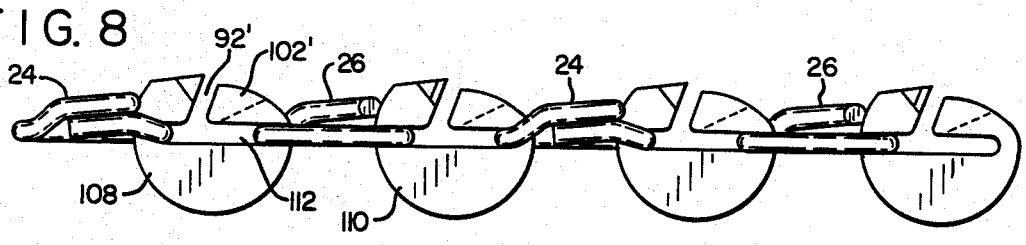
FIG. 8 is a side view of another embodiment of a cutting chain of the invention.

FIG. 8 illustrates a variant wherein the vertical links 108, 110 are formed with a horizontally extending slot 112 which intersects the slot 92'. The horizontal links 24, 26 are received within the slot 112 to provide interlink engagement. The slot 92' is of lesser width than the wire of links 24, 26 to prevent accidental disengagement. In assembly, the forward portion 102' is bent to one side to enlarge the slot 92' sufficient to slide the links 24–26 into place. Thereafter, it is bent back to its original position.

Figure 9:
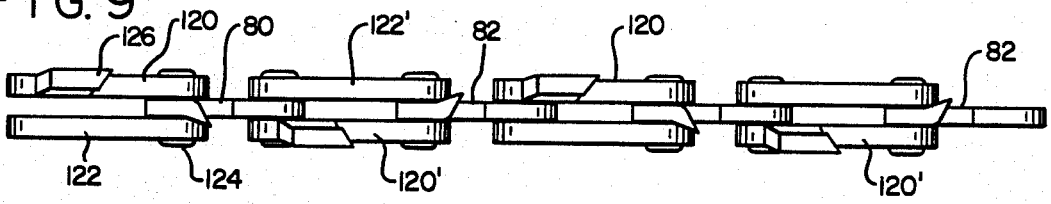
FIG. 9 is a top view of yet another embodiment of a cutting chain of the invention.
Figure 10:
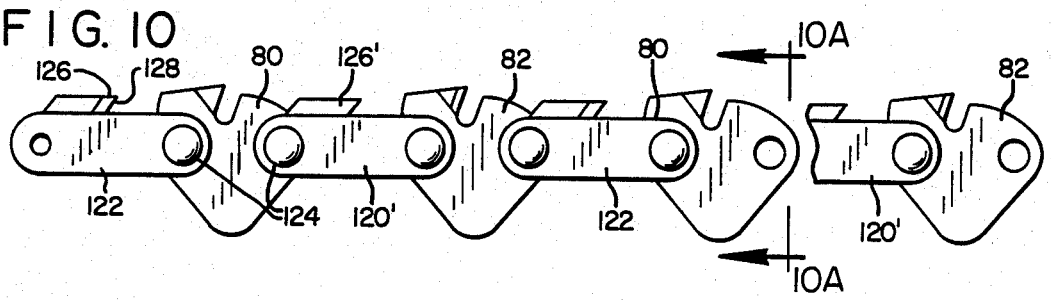
FIG. 10 is a side view of the cutting chain of FIG. 9.

The embodiment of FIGS. 9 and 10 comprises vertical links 80, 82 as described above. These are connected together by pairs of horizontal links 120, 122 and 120' and 122' by means of rivets 124. The links 120, 120' of each pair of side links is formed with a cutter element 126, 126', respectively on its upper edge. The cutter elements 126 are bent outwardly from the plane of the horizontal link and are provided with a front face 128 that defines top and side cutting edges 130, 132, respectively. The cutter elements 126 of the links 120 are disposed to project to the left of the chain, the cutters 126' of the links 120' project to the right. Again, the edges may be formed during the stamping operation forming the links 120, 120'.

The designs of the chain as shown are intended to be constructed to be small for small electric and battery powered power supplies. It is not intended that the chains be resharpened, although in at least some instances they may be. Because of the low cost of their manufacture, replacing a chain when it loses cutting efficiency is economically feasible. It should be readily apparent that the designs in accordance with the invention might also have uses in chains constructed for the conventional, larger power units such as the two-cycle gasoline engine.

Having illustrated and described the principles of our invention with reference to certain preferred embodiments, it should be apparent to those persons skilled in the art that such invention may be modified in arrangement and detail without departing from such principles. We claim as our invention all such modifications as come within the true spirit and scope of the following claims.

We claim:

1. A cutting chain for a chain saw or the like formed of a multiplicity of interconnected links which form an endless loop for mounting to a guide bar, having a cutting chain supporting groove therein, the cutting chain comprising, a plurality of vertically oriented first links each having an upwardly oriented cutting element and a lower portion configured to be received by said guide bar groove, a plurality of horizontally oriented second links interconnecting said first lines, and each of said second links having a cutting element extending laterally outwardly with respect to the central vertical plane of said chain, and the cutting elements of the first links projecting upwardly from the central horizontal plane of said chain loop a greater distance than the cutting elements of the horizontally oriented second links.

2. The cutting chain of claim 1 wherein the upwardly oriented cutting elements of the first links are angled from said vertical central plane.

3. The cutting chain of claim 2 wherein the cutting elements of alternating first links are angled in opposite directions from said vertical central plane.

4. The cutting chain of claim 1 wherein the sidewardly oriented cutting elements of alternating second links are oppositely directed relative to the said vertical central plane of said chain for cutting right and left of the endless loop.

5. The cutting chain of claim 1 wherein said lower portions of said first links comprise tangs for driving engagement with a drive sprocket.

6. The cutting chain of claim 5 wherein said second links each has an opening for receiving a tooth of said drive sprocket.

7. The cutting chain of claim 1 wherein said first and second links are alternately disposed in said chain.

8. The cutting chain of claim 1 wherein said first and second links are each comprised of a piece of wire, the ends of each piece of wire overlapping one another to form an enclosed ring like element, one of the wire ends of each link projecting from the enclosed shape, the end face of said one end having a sharp edge to define the cutting element of the link.

9. The cutting chain of claim 8 wherein the said end face of the wire of a link comprising the cutting element thereof extends at an acute angle to the axis of the wire.

10. The cutting chain of claim 8 wherein end portions of the wires of both the first and second links overlap.

11. The cutting chain of claim 1 wherein the first links are each comprised of a flat plate like member and the second links are each comprised of a piece of wire the ends of which overlap to form an enclosed shape, one of said wire ends projecting from the loop to comprise the cutting element of each second link.

12. A cutting chain formed of a multiplicity of interconnected links which form an endless loop for mounting to a guide bar, the cutting chain comprising a plurality of vertically oriented first links and horizontally oriented second links, each vertically oriented first link comprised of a piece of wire having two ends, the wire being bent to form substantially an enclosed shape, the upper portion of each said first link including an upwardly oriented cutting element, said cutting element being comprised of an end portion of said wire being projecting angularly upwardly from the enclosed shape, the lower portion of each first link being configured to be received by a groove in the guide bar for guiding the saw chain around the guide bar; and each horizontally oriented second link comprised of a piece of wire having two ends, the wire being bent to form substantially an enclosed shape, each said second link having a cutting element oriented sidewardly of the upwardly oriented cutting elements of the first links, said sidewardly oriented cutting element comprising an end portion of the wire projecting angularly outwardly to the side of said chain from the enclosed shape forming the second link.

13. The cutting chain of claim 12 wherein the upwardly oriented cutting element of said first links are angled from vertical.

14. The cutting chain of claim 13 wherein the cutting elements of alternating first links are oppositely angled from vertical.

15. The cutting chain of claim 12 wherein the sidewardly oriented cutting elements of alternating second links are oppositely directed relative to the side of said chain for cutting right and left of the endless loop.

16. The cutting chain of claim 12 wherein in certain of said links, the wire defining the same is folded back to itself near the center of the enclosed shape to prevent crosslinking and tangling of the links.

17. A cutting chain for a chain saw or the like formed of a multiplicity of interconnected links adapted to form an endless loop for mounting to a guide bar having a cutting chain supporting groove therein, said links including cutting links at least one of which comprises, a piece of wire having two ends, the wire being bent to form substantially an enclosed shape with the ends thereof vertically overlapping, the uppermost overlapping wire end projecting laterally from the enclosed shape to form a cutting element to effect cutting as the chain contacts and moves relative to the material to be cut, and other links including bar groove engaging portions which extend longitudinally along the chain and in said groove beneath cutting elements on said other links.

18. The cutting chain of claim 17 wherein the at least one end of the wire projecting from the loop is angle cut from the perpendicular to the axis of the wire to form the cutting element.

19. The cutting chain of claim 17 wherein the piece of wire in the at least one link is folded back to itself near the center of the enclosed shape to prevent crosslinking and tangling of the at least one link with other links.

* * * * *

UNITED STATES PATENT AND TRADEMARK OFFICE

CERTIFICATE OF CORRECTION

PATENT NO. :4,827,821

DATED :May 9, 1989

INVENTOR(S) :Lewis A. Scott, et al.

It is certified that error appears in the above-identified patent and that said Letters Patent is hereby corrected as shown below:

Column 3, line 11, the word "guie" should be "guide".
Column 3, line 49, the slash (/) after the word "degrees" should be a period (.).

Column 6, line 63, the word "lines" should be "links".
Column 6, line 66, after "chain," delete the word "and" and insert the following sentence -- each of said horizontally oriented second links comprising a loop shaped wire element hingedly engaging a pair of said first links, and -- .
Column 7, line 25, change "ring like" to: -- loop shaped -- .

Signed and Sealed this

Twentieth Day of February, 1990

*Attest:*

JEFFREY M. SAMUELS

*Attesting Officer* *Acting Commissioner of Patents and Trademarks*